United States Patent [19]

Ueda et al.

[11] Patent Number: 4,601,243

[45] Date of Patent: Jul. 22, 1986

[54] METHOD AND APPARATUS FOR ELECTRICALLY DETONATING BLASTING PRIMERS

[75] Inventors: Takeo Ueda; Yoshiro Ohsumi, both of Aichi, Japan

[73] Assignee: Nippon Oil and Fats Company, Limited, Tokyo, Japan

[21] Appl. No.: 656,891

[22] Filed: Oct. 2, 1984

[30] Foreign Application Priority Data

Oct. 19, 1983 [JP] Japan ..... 58-194118

[51] Int. Cl.[4] ..... F42D 1/04; F42C 11/00

[52] U.S. Cl. ..... 102/200; 102/206

[58] Field of Search ..... 102/217, 206, 200, 275.12

[56] References Cited

U.S. PATENT DOCUMENTS 4,425,849 1/1984 Jorgenson ..... 102/200

4,537,131 8/1985 Saunders ..... 102/217

*Primary Examiner*—Charles T. Jordan

*Attorney, Agent, or Firm*—Parkhurst & Oliff

[57] ABSTRACT

A number of detonating primers are electrically blasted by supplying a high frequency current through a bus wire formed by a pair of parallel conductors connected to each other at distal ends and having a constant impedance with which bus wire loops connected to the detonating primers via leg wires are electromagnetically coupled via a number of magnetic cores having slits formed therein. At first, one or more loops are inserted into respective magnetic core through the slit and one of the parallel conductors is also inserted into the magnetic core through the slit. When the high frequency current having a frequency from 100 KHz to 1 MHz is passed through the conductors of bus wire in opposite directions, there is induce electromagnetically secondary high frequency currents in respective loops, which are supplied to respective detonating primers for explosion.

15 Claims, 10 Drawing Figures

High Frequency Converting Unit
DC/DC Converter
Pulse Generating Unit
21
22
23
23a
23b
24
25
26
27
28
29
30
31
32
33
34
35
36
37
38
39A
39B
39a
39b
40
41
42
43
44
45
46
47
48
49
50
51

METHOD AND APPARATUS FOR ELECTRICALLY DETONATING BLASTING PRIMERS

BACKGROUND OF THE INVENTION

The present invention generally relates to a technique for electrically blasting percussion powders of detonating primers, and more particularly to a method and an apparatus for blasting electrically a number of detonating primers electromagnetically coupled with a bus wire via magnetic cores by supplying a high frequency electric current to the bus wire.

FIG. 1 illustrates a known blasting apparatus by means of which a plurality of detonating primers electromagnetically coupled with a bus wire serially are electrically exploded. Such a known apparatus has been described in, for instance Japanese Patent Application Laid-open Publication No. 22,608/74. The apparatus comprises an oscillator unit 1 including a voltage supply source 2 such as a battery, a capacitor 3 charged by the battery 2, a trigger circuit 4 and a silicon controlled rectifier 5 which can be switched on by the trigger circuit 4. When the trigger circuit 4 is actuated, the oscillator unit 1 produces a pulsatory voltage having a large amplitude across outputs 6 and 7 to which a loop-like bus wire 8 is connected. Therefore a pulsatory current flows through the loop-like bus wire 8. To the bus wire 8 are electromagnetically coupled a number of transformer units 9 each having a magnetic core 10 and a secondary winding 11 wound on the core. Through the cores 10 the bus wire 8 is passed as a primary winding. To both ends of the secondary windings 11 are connected leg wires 12 and 13 of a number of detonating primers 14 which are coupled with blasting explosives 15. When the pulsatory current supplied from the oscillator unit 1 flows through the bus wire 8, pulsatory currents are electromagnetically induced in the leg wires 12 and 13 of the respective detonating primers 14, and thus the detonating primers 14 are exploded primarily. Then the explosives 15 coupled with the detonating primers 14 are blasted secondarily.

In the above explained known blasting method, since the current flowing through the bus wire 8, i.e. the primary winding of the transformer unit 9, has several hundred hertzs, the magnetic core 10 is liable to be large in size and heavy in weight. Therefore, it is difficult or at least cumbersome to carry and handle such large and heavy magnetic cores. In this connection, it should be noted that the number of detonating primers 14 to be coupled with the same and single bus wire 8 often amounts to several tens to several hundreds.

Moreover, in the known method, it is necessary to connect the leg wires 12 and 13 of respective detonating primer 14 to the secondary winding 11 which has been previously wound on the magnetic core 10. This requires very cumbersome operation of a user.

Furthermore, in the known method, the bus wire 8 should be passed through the ring-shaped magnetic cores 10 at places at which the explosion is to be effected. The operation for passing the bus wire through a number of cores is apparently very cumbersome. Particularly, when the number of magnetic cores 10 which have been passed through the bus wire 8 is increased, the bus wire is liable to become entangled with the magnetic cores 10. In order to avoid this, it is necessary to pull or draw the bus wire 8 rather strongly. However, when the bus wire 8 is pulled strongly, the leg wires 12, 13 of detonating primer 14 are subjected to a strong tensile force and unexpected shock might be applied to the detonating primer. This is very undesirable in the view point of safety. Moreover, in an extreme case the detonating primer 14 might be pulled out of the blasting explosive 15.

In the known method, the bus wire 8 forms a loop. Now it is assumed that the bus wire 8 has a diameter a and the loop has a diameter b as schematically illustrated in FIG. 2. Then an impedance Z of the loop formed by the bus wire 8 is expressed by the following equation, where f is a frequency of the current flowing through the bus wire 8, and N is the number of turns.

$$Z=2\pi f\cdot 4\pi bN^2(\log 8b/a-2)\cdot 10^{-7}$$

From this equation, it is apparent that when an inductance of the loop represented by $4\pi bN^2(\log 8b/a-2)10^{-7}$ is changed, the impedance Z is also varied. The inductance of the loop will be changed in accordance with the configuration of the loop and the loop configuration will be varied in accordance with the fact how to lead or extend the bus wire 8. Further, in case of effecting the explosion under the sea, the loop of the bus wire will be changed in accordance with conditions of environment. Therefore, in the known method, the frequency of the output of the oscillator unit 1 has to be adjusted in accordance with the variation of the impedance of the bus wire 8 forming the loop, and therefore it is difficult to attain the stable operation under various conditions.

SUMMARY OF THE INVENTION

The present invention has for its object to provide an improved method of blasting electrically a number of detonating primers having loops electromagnetically coupled with a bus wire by means of magnetic cores, in which a pulsatory current having a sufficient amplitude for exploding percussion powders of the detonating primers can be electromagnetically induced by means of magnetic cores through which the bus wire can be easily and correctly passed, while an impedance of the bus wire can be maintained substantially unchanged regardless of conditions of the bus wire.

It is another object of the invention to provide a method of electrically blasting a number of detonating primers electromagnetically coupled with a bus wire via magnetic cores, in which a high frequency can pass through the bus wire, and thus small and light magnetic cores can be used, while sufficiently large energy can be supplied to the detonating primers.

According to the invention, a method of blasting electrically a plurality of detonating primers by supplying an electric current through a bus wire with which leg wires of detonating primers are electromagnetically coupled by means of a plurality of magnetic cores, comprises inserting loop connected to said leg wires of detonating primers into said magnetic cores through openings thereof;

inserting a plurality of portions of one conductor of said bus wire into the respective magnetic cores through openings thereof, the other conductor of the bus wire being spaced from said one conductor by a substantially constant distance so that the bus wire has a substantially constant impedance; and flowing a high frequency current through said bus wire to induce in the respective loops a high frequency secondary current due to a transforming action of said magnetic cores, whereby said induced high frequency currents are supplied to the respective detonating primers through the leg wires to blast the detonating primers.

The present invention also relates to an apparatus for electrically blasting a number of detonating primers having loops electromagnetically coupled with a bus wire by means of magnetic cores and has for its object to provide a novel and useful apparatus which can positively explode the detonating primers by using small and light magnetic cores and can be made simple in construction and small in size.

According to the invention, an apparatus for blasting electrically a plurality of detonating primers by supplying an electric current through a bus wire with which leg wires of detonating primers are electromagnetically coupled by means of a plurality of magnetic cores, comprises means for generating a pulsatory high voltage;

means for converting the pulsatory high voltage into a high frequency current;

a bus wire comprising a pair of conductors which are separated from each other substantially by a constant distance over its whole length and have distal ends connected to each other, so that said high frequency current passes through said conductors in opposite directions, said bus wire having a substantially constant impedance;

a plurality of magnetic cores each having an opening through which one of said conductors of the bus wire is inserted into the magnetic core; and a plurality of loops each connected to a respective detonating primer via leg wires, said loop being inserted into the magnetic core through said opening.

BRIEF DESCRIPTION OF THE INVENTION

DESCRIPTION OF THE PREFERRED EMBODIMENTS

Figure 1:
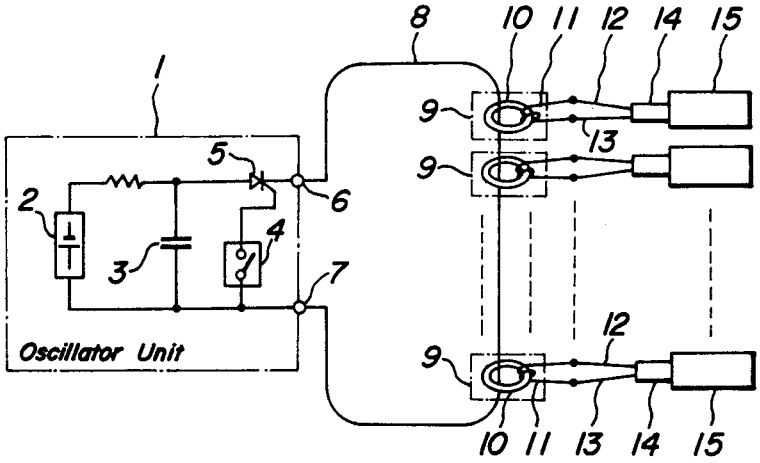
FIG. 1 PRIOR ART
FIG. 1 is a circuit diagram showing a known apparatus for blasting electrically detonating primers.
Figure 2:
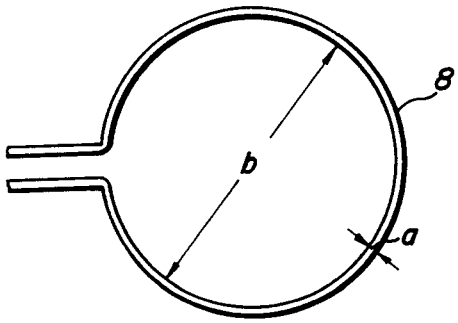
FIG. 2 PRIOR ART
FIG. 2 is a schematic diagram showing a loop formed by a bus wire of the known apparatus.
Figure 3:
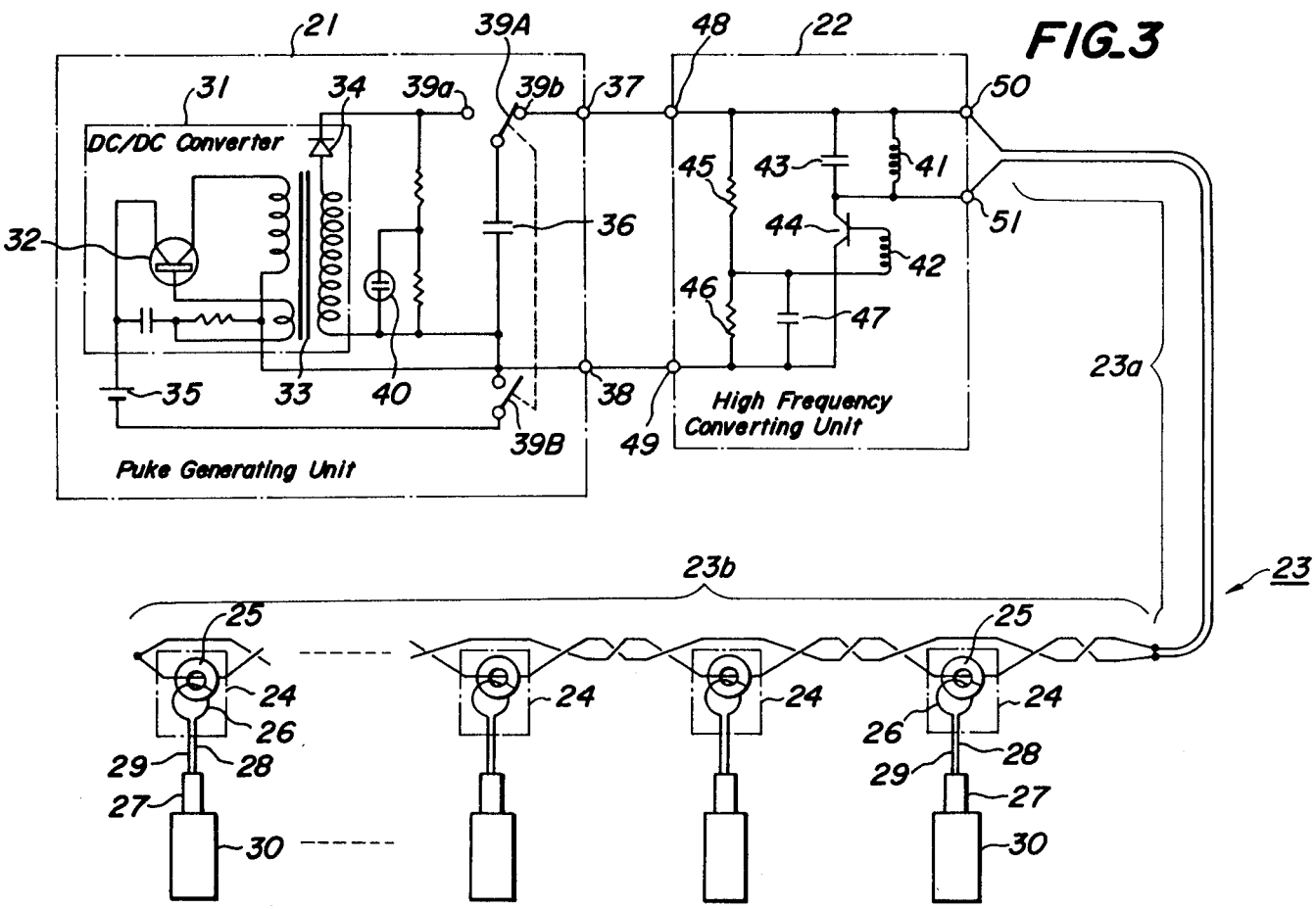
FIG. 3 is a circuit diagram illustrating an embodiment of the electric blasting apparatus according to the invention.

FIG. 3 is a circuit diagram showing an embodiment of the electric blasting apparatus according to the invention. The apparatus comprises a pulse generating unit 21, a high frequency converting unit 22 connected to the pulse generating unit 21, a bus wire 23 connected to the high frequency converting unit 22 and a number of transforming units 24 including magnetic cores 25 electromagnetically coupled with the bus wire 23. The transforming units 24 further comprise loops 26 which are electromagnetically coupled with the magnetic cores 25 and are connected to detonating primers 27 by means of leg wires 28 and 29. The detonating primers 27 are coupled with explosives 30 in any known manner.

Figure 4A:
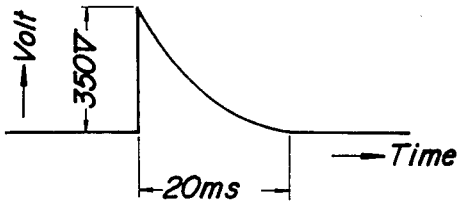
FIGS. 4A and 4B are waveforms for explaining the operation of the apparatus shown in FIG. 3.

The pulse generating circuit 21 comprises a DC/DC converter 31 formed as a known booster unit including a transistor 32, a transformer 33 and a diode 34. The DC/DC converter 31 converts a relatively low D.C. voltage of, for instance 6 Volts of a battery 35 into a high voltage of for instance 350 volts which appears across a charging and discharging capacitor 36 which is selectively connectable either to the DC/DC converter 31 or to outputs 37 and 38 of the pulse generating unit 21 by means of cooperative switches 39A and 39B. At first, the switching arm of switch 39A is connected to a contact **39*a* to charge the capacitor 36. When the capacitor 36 has been charged to a sufficient level, a voltage indication lamp 40 is lit. Then, a user can know that the pulse generating unit 21 has been ready for producing the voltage pulse having a sufficient amplitude for blasting the detonating primers 27. When the switching arm of switch 39A is changed into a contact 39*b* as illustrated in FIG. 3, the capacitor 36 starts to discharge. In this manner, the pulse generating unit 21 produces across its outputs 37 and 38 a pulsatory output voltage of a large amplitude as illustrated in FIG. 4A**.

Figure 4B:
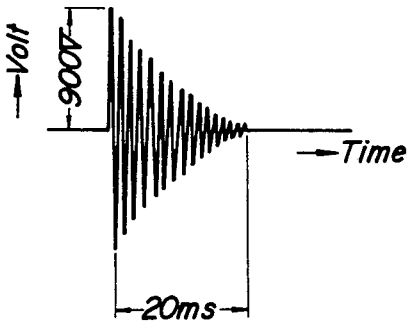

The high frequency converting unit 22 comprises tuning coils 41, 42, tuning capacitor 43, transistor 44, bias resistors 45, 46 and bias capacitor 47, these elements forming a well known oscillating circuit. The pulsatory voltage applied to inputs 48 and 49 of the high frequency converting unit 22 is converted thereby into a high frequency voltage illustrated in FIG. 4B. In this manner, the high frequency voltage appears across outputs 50 and 51 of the high frequency converting unit 22, and thus a corresponding high frequency current flows through the bus wire 23 connected across the outputs 50 and 51. As depicted in FIG. 4B, the high frequency voltage lasts for about 20 mS and has the maximum peak value of about 900 V. The frequency of the high frequency voltage is determined by the inductances of the tuning coil 41 and bus wire 23 and the capacitance of the tuning capacitor 43 and may be set to a value within a range from 50 KHz to 1 MHz, preferably 50 KHz to 200 KHz.

According to the invention, the bus wire 23 has a substantially constant impedance. This will be explained hereinbelow. The bus wire 23 according to the invention may be formed by a pair of parallel conductors whose distal ends are connected to each other. In such a parallel line, the impedance Zo of the bus wire 23 is expressed as follows.

$$Zo = 276 \log_{10} (2D/d)$$

wherein D is a distance between the parallel conductors and d is a diameter of the conductors. From the above equation, it is apparent that the impedance Zo of the bus wire 23 according to the invention is maintained constant as long as the distance D and diameter d are constant. The same may be applied to the bus wire which is formed by a pair of twisted conductors whose distal ends are short-circuited. In this case, said distance D may be an average distance between the two conductors. In the embodiment shown in FIG. 3, the bus wire 23 is composed of a main bus wire **23*a* formed by a pair of parallel conductors and a sub bus wire 23*b* formed by a pair of twisted conductors having one ends connected to the parallel conductors of the main bus wire 23*a* and the other ends connected to each other. It should be noted the main bus wire 23***a* is used repeatedly, but the sub bus wire 23*b* is broken into pieces upon explosion.

According to the invention, since use is made of the bus wire 23 having a substantially constant impedance in regardless of the conditions of the bus wire, i.e. how to lead or extend the bus wire, it is not necessary to adjust the operation frequency of the high frequency converting unit 22 and the stable explosion can be always attained. Further, since it is possible to use always the high frequency current, the magnetic core 25 can be made small in size and light in weight.

Figure 5A:
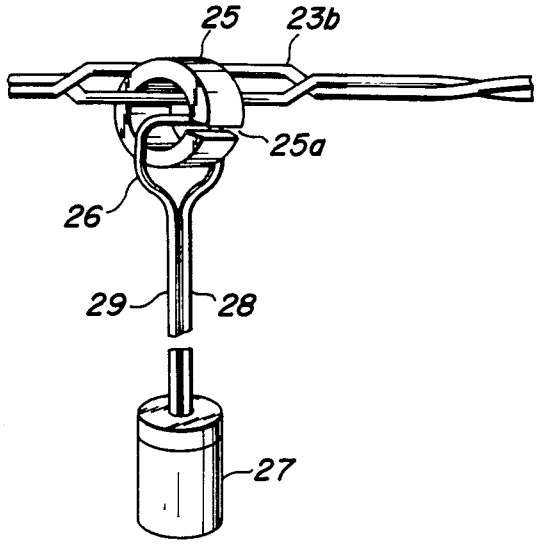
FIGS. 5A and 5B are perspective views illustrating two embodiments of a magnetic core according to the invention.

The bus wire 23 is electromagnetically coupled with a number of the transforming units 24 at many desired positions. According to the invention, the transforming unit 24 comprises a magnetic core 25 having a slit 25*a* as shown in FIG. 5A. The slit 25*a* has such a dimension that one conductor of the twisted bus wire 23*b* can be inserted into the magnetic core 25 through the slit 25*a* in an easy and positive manner. Further, the loop 26 connected to the detonating primer 27 can be also inserted into the magnetic core 25 through the slit 25*a*. As shown in FIG. 5A, the loop 26 has been connected to the detonating primer 27 by means of parallel leg wires 28 and 29. In this manner, the loops 26 can be easily and positively passed through the magnetic cores 25. In this case, the leg wires 28 and 29 of the detonating primer 27 are not subjected to any undesired tensile force and the detonating primer can be completely protected against unexpected explosion, because it is not necessary to pull the bus wire.

When the high frequency current flows through the bus wire 23 having the constant impedance, secondary high frequency currents are electromagnetically induced in the loops 26 of respective detonating primers 27 and the induced currents flows through filaments in the detonating primers via the leg wires 28 and 29. In this manner, the detonating primers 27 are blasted effectively, and then explosives 30 coupled with the detonating primers 27 are also exploded.

Now a numerical example of the electric blasting apparatus according to the invention will be explained in detail.

In the present example, two hundred detonating primers of instantaneous explosion type 27 are to be blasted simultaneously. The capacitor 36 in the pulse generating unit 21 has a capacitance value of 400 $\mu$F and the battery voltage of 6 volts is increased up to about 350 volts at the outputs 37 and 38. The tuning coils 41 and 42 of the high frequency converting unit 22 have inductances of 45 $\mu$H and 5 $\mu$H, respectively, the tuning capacitor 43 has a capacitance of 0.047 $\mu$F, the transistor 44 is formed by a switching power transistor of high speed and high tension type, the bias resistors 45 and 46 have resistances of 5 K$\Omega$ and 50$\Omega$, respectively, and the bias capacitor 47 has a capacitance of 1 $\mu$F. Then, the high frequency converting unit 22 produces across its outputs 50 and 51 the high frequency voltage pulse having the maximum peak voltage of about 900 volts and the frequency of 100 KHz to 140 KHz.

The bus wire 23 is formed by the main bus wire 23*a* and sub bus wire 23*b*. The main bus wire 23*a* is consisting of the parallel conductors having a D.C. resistance of 2.4$\Omega$ and a length of 100 m. Each conductor has a cross section of 1.25 mm$^2$. The sub bus wire 23*b* is formed by the twisted conductors having a D.C. resistance of 5.7$\Omega$, a length of 50 m and a twisting pitch of about 50 mm. Each conductor has a cross section of 0.28 mm$^2$.

Figure 6:
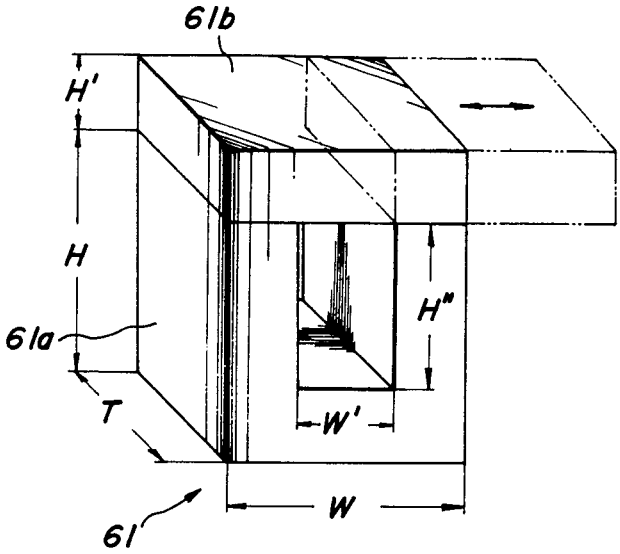
FIG. 6 is a perspective view showing another embodiment of the magnetic core according to the invention.

In the present example, use is made of a rectangular magnetic core shown in FIG. 6 instead of the ring-shaped magnetic core illustrated in FIG. 5A. In FIG. 6, the magnetic core 61 comprises a substantially U-shaped main block 61*a* and a bridge block 61*b* which is slidable with respect to the main block 61*a* as shown by a double headed arrow. That is to say, the main block 61*a* is fixed to a frame (not shown) made of non-magnetic material such as plastics and the bridge block 61*b* is slidably secured to the frame. When the bridge block 61*b* is moved as shown by a chain line, an upper opening of the main block 61*a* is exposed. Then, one conductor of the sub bus wire 23*b* and the loop 26 of the primers 27 can be inserted into a space substantially surrounded by the main block 61*a* through the exposed opening. After that, the bridge block 61*b* is moved into the position shown by a solid line to enclose the conductor of sub bus wire 23*b* and loop 26 within the space of the magnetic core 61. The main block 61*a* has a height H of 15 mm, width W of 15 mm and a thickness T of 10 mm. The bridge block 61*b* has height H' of 5 mm. The space has a height H'' of 10 mm, and a width W' of 5 mm. The main block 61*a* and bridge block 61*b* are preferably made of ferrite.

In the present example, there are prepared forty rectangular magnetic cores 61 shown in FIG. 6 and in a space of each magnetic core are inserted at first five loops 26 of detonating primers 27. Then one conductor of the sub wire 23*b* is inserted into the space. After that, the space is closed by shifting the bridge block 61*b*. The loop 26 is formed by a conductor having a diameter of 0.45 mm and has a diameter of about 100 mm. Both ends of the loop 26 have been connected to the detonating primer 27 by means of the leg wires 28 and 29 having a length of 1.5 m. The loop 26 and leg wires 28, 29 are formed by conductors having insulating coatings applied thereon. The detonating primers 27 have the minimum blasting energy of 3 to 4 milli Joules.

After sufficient amount of charge has been confirmed to be stored in the capacitor 36 by the indication lamp 40, when the switching arm of switch 39A is changed into the contact 39*b*, all the two hundred detonating primers 27 and explosives 30 are completely blasted at a time.

Figure 7A:
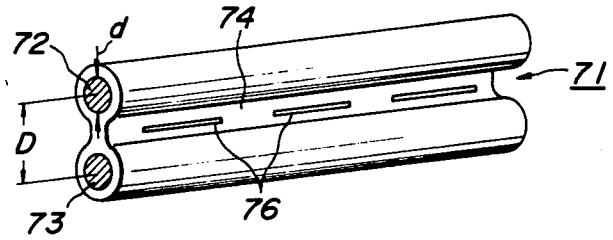
FIGS. 7A and 7B are perspective views depicting an embodiment of a bus wire according to the invention.
Figure 7B:
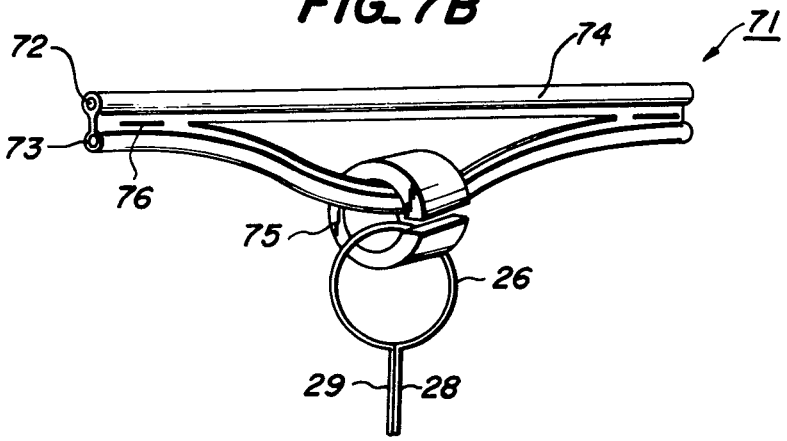

The present invention is not limited to the above mentioned embodiments, but many modifications and alternations can be conceived within the scope of the invention. For instance, the sub bus wire may be also formed by a parallel wire as shown in FIG. 7A. The parallel wire 71 comprises a pair of conductors 72 and 73 having a diameter d of 0.6 mm and being spaced from each other by a distance D of 1 to 2 mm. The conductors 72 and 73 are supported in parallel with each other by means of a strip-like insulating member 74. In case of passing the conductor 73 through the magnetic core 75 as shown in FIG. 7B, the insulating member 74 is partially cut. For this purpose, there may be formed slits 76 in the insulating member 74 along the longitudinal direction of the bus wire 71.

Figure 5B:
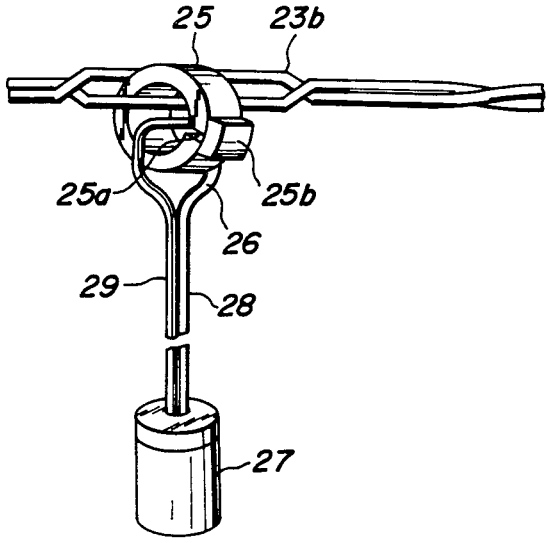

Further, the magnetic core 61 shown in FIG. 6 may be fit into a clip-like frame. In this case, the bridge block 61*b* may be secured to a swingable arm of the clip-like frame. Moreover, as shown in FIG. 5B the slit 25*a* of the magnetic core 25 may be closed by a bridge piece 25*b*. The bridge piece 25*b* may be secured to the core 25 by any suitable means such as adhesive agent and adhesive tape, after the conductor of the bus wire 23*b* and the loop 26 of the detonating primer 27 are inserted into the core 25 through the slit 25*a*. It has been confirmed experimently that when the frequency of the high frequency current passing through the bus wire is relatively low, it is preferable to close the slit or opening of magnetic core by means of magnetic bridge member. Contrary to this, when the current flowing through the bus wire has a sufficiently high frequency, the slit or opening of magnetic core 25 is not always necessary to be closed by the magnetic bridge member.

As explained above, according to the invention, since the bus wire does not form the loop and is formed by the twisted wire or parallel wire which has the constant low impedance, the impedance of the bus wire is not changed regardless of the conditions of the bus wire, and further the impedance of the bus wire is not changed by the frequency of the high frequency current. Therefore, the detonating primers can be always blasted stably. It is apparent that the high frequency converting unit can be simple in construction.

Furthermore, since use is made of the magnetic core having the slit or opening, the bus wire and the loop of the detonating primer can be inserted into the core through the slit or opening in an easy and possitive manner. During this operation, the leg wires of the detonating primer are not subjected to undesired tensile force, and thus any unexpected shock is not applied to the primer.

Moreover, according to the invention since the high frequency current can be alway passed through the bus wire, the magnetic core can be made small in size and light in weight. Therefore, a number of magnetic cores can be handled and transported easily.

According to the invention, the bus wire comprises a pair of parallel conductors through which the blasting high frequency current passes in opposite directions, there occurs substantially no antenna effect and thus undesired radiation of the electromagnetic wave can be effectively prevented.

What is claimed is:

1. A method of blasting electrically a plurality of detonating primers by supplying an electric current through a bus wire with which leg wires of detonating primers are electromagnetically coupled by means of a plurality of magnetic cores, comprising inserting loops connected to said leg wires of detonating primers into said magnetic cores through openings thereof;

inserting a plurality of portions of one conductor of said bus wire into the respective magnetic cores through openings thereof, the other conductor of the bus wire being spaced from said one conductor by a substantially constant distance so that the bus wire has a substantially constant impedance; and flowing a high frequency current through said bus wire to induce in the respective loops a high frequency secondary current due to a transforming action of said magnetic cores, whereby said induced high frequency currents are supplied to the respective detonating primers through the leg wires to blast the detonating primers.

2. A method according to claim 1, wherein each of said openings of magnetic cores is closed by means of a magnetic bridge member after the conductor of the bus wire and the loop connected to the detonating primer have been inserted into the magnetic core through said opening.

3. A method according to claim 1, wherein said high frequency current is passed through the bus wire formed by a pair of twisted conductors having the distal end connected to each other.

4. A method according to claim 1, wherein said high frequency current is passed through the bus wire formed by a pair of parallel conductors having distal ends connected to each other.

5. A method according to claim 1, wherein through said bus wire is passed the high frequency current having a frequency within a range from 50 KHz to 1 MHz, preferably 50 KHz to 200 KHz.

6. A method according to claim 1, wherein said high frequency current passing through the bus wire is produced by boosting a low D.C. voltage into a pulsatory high voltage and by converting the pulsatory high voltage into the high frequency current.

7. An apparatus for blasting electrically a plurality of detonating primers by supplying an electric current through a bus wire with which leg wires of detonating primers are electromagnetically coupled by means of a plurality of magnetic cores, comprising means for generating a pulsatory high voltage;

means for converting the pulsatory high voltage into a high frequency current;

a bus wire comprising a pair of conductors which are separated from each other substantially by a constant distance over its whole length and have distal ends connected to each other, so that said high frequency current passes through said conductors in opposite directions, said bus wire having a substantially constant impedance;

a plurality of magnetic cores each having an opening through which one of said conductors of the bus wire is inserted into the magnetic core; and a plurality of loops each connected to a respective detonating primer via leg wires, said loop being inserted into the magnetic core through said opening.

8. An apparatus according to claim 7, wherein said bus wire is formed by a pair of twisted conductors having distal ends connected to each other.

9. An apparatus according to claim 7, wherein said bus wire is formed by a pair of parallel conductors separated by a strip-like insulating member and having both ends connected to each other.

10. An apparatus according to claim 9, wherein said strip-like insulating member has formed therein a number of slits extending in its longitudinal direction.

11. An apparatus according to claim 7, wherein said bus wire comprises a main bus wire formed by a pair of parallel conductors separated by a strip-like insulating member, and a sub bus wire formed by a pair of twisted conductors having one ends connected to ends of said parallel conductors and the other ends connected to each other, whereby said main bus wire is used repeatedly.

12. An apparatus according to claim 8, wherein said magnetic core is formed by a ring-shaped magnetic core and said opening is formed by a slit.

13. An apparatus according to claim 8, wherein said magnetic core comprises a magnetic bridge member which closes said opening after the conductor of bus wire and loop of detonating primer are inserted into the magnetic core through the opening.

14. An apparatus according to claim 7, wherein said pulsatory voltage generating means comprises a DC/DC converter for converting a low D.C. voltage of a battery into a high D.C. voltage and a capacitor which is charged by the high D.C. voltage and then is discharged to generate said pulsatory high voltage, and said high frequency current converting means comprises an oscillator supplied with said pulsatory high voltage to generate the high frequency current.

15. An apparatus according to claim 14, wherein said oscillator of the high frequency current converting means is constructed to generate the high frequency current of 100 KHz to 1 MHz.

* * * * *